United States Patent [19]

Michalovic et al.

[11] Patent Number: 5,074,196

[45] Date of Patent: Dec. 24, 1991

[54] FLEXIBLE GAS IMPERMEABLE SANDWICH DIAPHRAGM

[75] Inventors: John G. Michalovic, Amherst; Franklin A. Vassallo, Lancaster, both of N.Y.

[73] Assignee: Calspan Corporation, Buffalo, N.Y.

[21] Appl. No.: 589,829

[22] Filed: Sep. 28, 1990

[51] Int. Cl.[5] ..... F01B 19/00

[52] U.S. Cl. ..... 92/98 R; 92/103 R; 92/103 F; 92/103 M

[58] Field of Search ..... 92/96, 98 R, 99, 102, 92/103 R, 103 F, 103 SD, 103 M

[56] References Cited

U.S. PATENT DOCUMENTS

| | | | |
|---|---|---|---|
| 2,730,131 | 1/1956 | Asp et al. | 92/103 SD |
| 2,808,484 | 10/1957 | Beck et al. | 92/103 SD |
| 2,916,255 | 12/1959 | Koehler | 92/103 R |
| 3,026,909 | 1/1962 | Boteler | 137/793 |
| 3,249,022 | 5/1966 | Bolger, Jr. | 92/103 SD |
| 3,668,978 | 6/1972 | Bowen | 92/98 R |
| 3,982,559 | 9/1976 | Ochs | 92/97 |
| 4,022,114 | 5/1977 | Hansen et al. | 92/98 R |
| 4,569,634 | 4/1986 | Mantell | 417/63 |
| 4,644,847 | 2/1987 | Wolf | 92/98 R |
| 4,773,832 | 9/1988 | Muck | 92/103 SD |
| 4,837,068 | 6/1989 | Martin et al. | 92/103 SD |
| 4,989,497 | 2/1991 | Lerma | 92/103 SD |

FOREIGN PATENT DOCUMENTS

| | | | |
|---|---|---|---|
| 202790 | 4/1959 | Austria | 92/103 R |
| 283021 | 1/1928 | United Kingdom | 92/103 R |
| 718081 | 11/1954 | United Kingdom | 92/103 SD |
| 799335 | 8/1958 | United Kingdom | 92/103 R |

*Primary Examiner*—Edward K. Look
*Assistant Examiner*—Thomas Denion
*Attorney, Agent, or Firm*—Biebel & French

[57] ABSTRACT

The present invention provides a compliant molded diaphragm which includes an operable surface area for forming a flexiblle barrier to prevent fluid flow between opposing sides of the diaphragm. The diaphragm is formed as a sandwich structure having first and second elastomeric layers and a third gas impermeable layer located between the first and second layers. The third layer may be provided as a thin layer of metal which is vapor deposited between the two elastomeric layers or may be a thin gas impermeable polymer film. The impermeable layer is preferably formed as a grid pattern in the operable surface area of the diaphragm such that portions of the first and second layers are exposed to each other whereby the first and second layers may be bonded to each other to prevent separation of the layers of the diaphragm.

17 Claims, 1 Drawing Sheet

FLEXIBLE GAS IMPERMEABLE SANDWICH DIAPHRAGM

BACKGROUND OF THE INVENTION

The present invention relates to a diaphragm for use in compressors and, more particularly, to a diaphragm formed with a sandwich structure to form an impermeable barrier to gases within a compressor.

Compressors for use in refrigeration systems often include a simple piston and cylinder configuration in which the piston draws refrigerant in through one port of the cylinder and pushes it out through a second port. The piston and cylinder must be provided with a lubricating oil and, in the absence of a barrier between the piston and the refrigerant fluid used in the system, oil will be found in the refrigerant thus decreasing the efficiency of the refrigeration system.

In an effort to separate the refrigerant from the oil lubricated parts, refrigeration compressors are provided with a diaphragm located above the piston and attached to the cylinder walls. The diaphragm is often in the form of a thin metal disk or a sheet of homogeneous flexible material positioned to flex away from and toward the input and output ports of the compressor to thereby force the refrigerant through the refrigeration system.

Diaphragms formed of metallic materials have been subject to early fatigue failure, particularly in the areas where the diaphragm is connected to the sides of the cylinder, and also require the piston to perform more work to overcome the stiffness of the diaphragm as the diaphragm is moved in and out to pump the refrigerant.

While diaphragms formed of homogeneous flexible materials have increased the efficiency of the pumping action due to their flexibility, and have reduced the problems associated with fatigue at the attachment points to the cylinder, these materials have proven to be relatively permeable and thus do not effectively separate the refrigerant from the lubricated parts of the compressor.

Accordingly, there is a need for a highly flexible diaphragm which is resistant to the permeability of gases such as Freon 502 which are used in refrigeration systems. Such a diaphragm must also be resistant to wear which may result from contact with the piston or with surfaces within the cylinder.

In addition, there is a need for an impermeable diaphragm which is capable of accommodating repetitive sharp flexures of the diaphragm material.

SUMMARY OF THE INVENTION

The present invention provides a compliant diaphragm which has an operable surface area which is configured to substantially overlie the piston within a refrigerant compressor.

The diaphragm is formed of two layers of elastomeric material and includes an impermeable membrane located between the elastomer layers such that the operable surface is formed as a flexible barrier to prevent fluid flow between opposing sides of the diaphragm.

The impermeable layer may be formed as a thin film of metal or as a semi-elastic polymer film. The elastomer layers are initially provided in an uncured state and the impermeable layer is positioned between the elastomer layers. The elastomer layers are then cured in the presence of heat and pressure such that the impermeable layer is embedded within and sandwiched between the elastomer layers to form an impermeable barrier to refrigerant gases.

The impermeable layer may be further provided in the form of a grid pattern in which at least 50% of the operable surface area of the diaphragm is covered with the impermeable layer. Thus, in the spaces in the grid pattern between the locations of the impermeable material, the two layers of elastomeric material may be bonded to each other to form strong bond connections therebetween such that separation of the elastomer layers from each other is prevented.

In addition, the impermeable layer may be limited to being substantially coextensive with the operable surface area such that the peripheral portions of the diaphragm which are attached to the sides of the cylinder include only the two elastomer layers. Thus, the elastomer layers along the outer edge may be bonded to each other to fully enclose and thereby positively retain the impermeable layer.

Therefore, the present invention provides a compliant molded diaphragm having an operable surface area for forming a flexible barrier to prevent fluid flow between opposing sides of the diaphragm. First and second layers of the diaphragm are formed of a first elastomeric material and a third gas impermeable layer is located between the first and second layers wherein the third layer is substantially thinner than the first and second layers such that the flexibility of the diaphragm is not substantially effected by the inclusion of the third layer. In addition, the third layer is formed of a second material which is different from and less permeable than the first material and extends substantially coextensively with the operable surface area to thereby inhibit passage of fluids through the diaphragm.

Other objects and advantages of the invention will be apparent from the following description, the accompanying drawings, and the appended claims.

DETAILED DESCRIPTION OF THE PREFERRED EMBODIMENT

Figure 1:
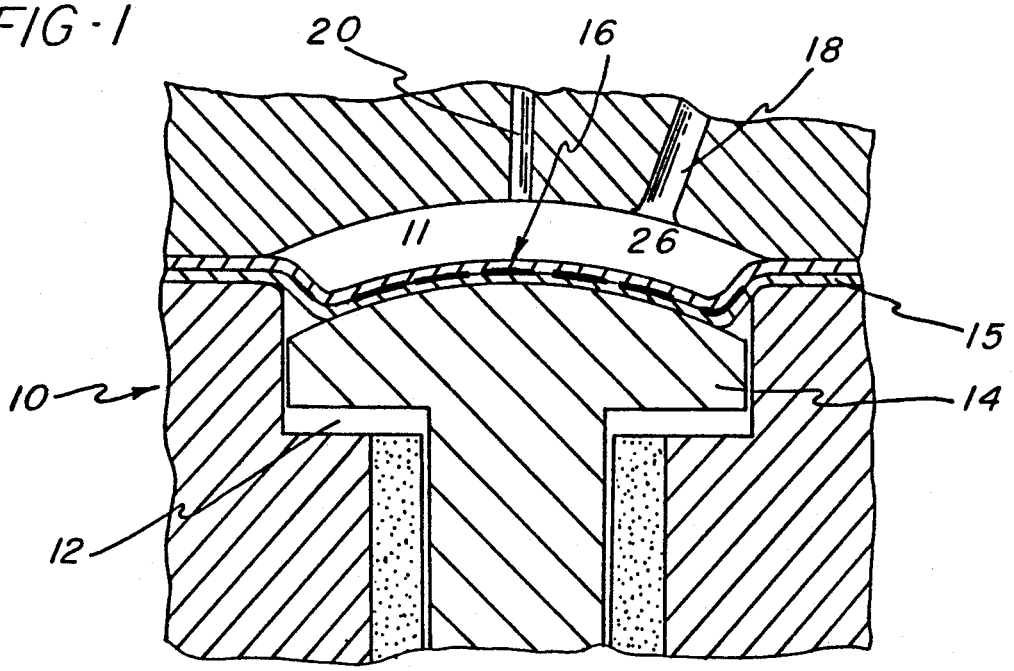
FIG. 1 is a cross-sectional view of a typical compressor cylinder incorporating the diaphragm of the present invention.

As may be seen in FIG. 1, the diaphragm 16 of the present invention is configured to be incorporated into a refrigeration compressor 10 which includes a cylinder 12 and a piston 14 reciprocably movable therein having a typical stroke of approximately 0.113 inch.

The piston 14 is shown at its lowermost point and the diaphragm 16 can be seen to undergo a flexure in a first direction downwardly adjacent to the cylinder wall and a second flexure in an opposite direction along radial points spaced from the cylinder wall.

Figure 2:
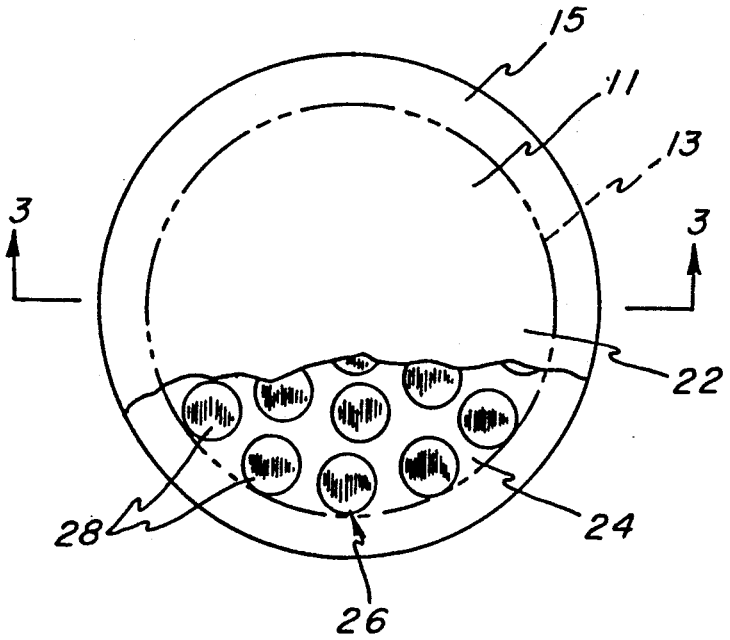
FIG. 2 is a plan view of the diaphragm of the present invention with the top layer of the elastomeric material partially cut away.

The diaphragm 16 includes an operable surface area 11 extending across substantially the entire diameter of the cylinder 12 and piston 14 and is defined by the phantom line 13 in FIG. 2. The peripheral rim portion 15 of the diaphragm 16 radially outside of the line 13, may be used to mount the diaphragm 16 to the wall of the cylinder 12. Thus, the line 13 approximately corresponds to the point where the diaphragm 16 undergoes a sharp flexure downwardly.

The diaphragm 16 of the present invention forms a fluid barrier between the upper and lower portions of the cylinder 12 whereby oil for lubricating the contact surfaces between the piston 14 and cylinder 12 is separated form refrigeration fluid which is drawn in through inlet port 18 and expelled through exhaust port 20 of the compressor 10. Separation of the refrigeration fluid from the lubricating oil by means of the diaphragm 16 results in the refrigeration system operating more efficiently than if a mixture of oil and refrigeration fluid is pumped through the system and further prevents the refrigerant from escaping from the system between the piston 14 and the cylinder walls.

Figure 3:
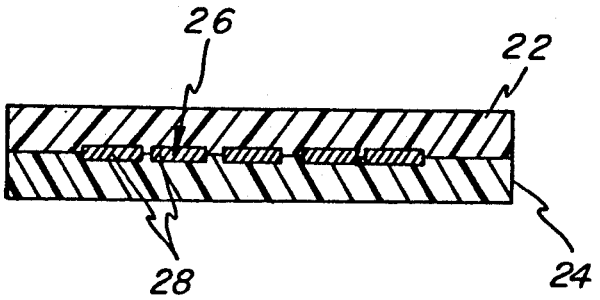
FIG. 3 is a cross-sectional view taken along line 3—3 in FIG. 2 and in which the thickness of the diaphragm is shown exaggerated.

The diaphragm 16 is formed as a compliant structure and includes first and second layers 22 and 24 which are of substantially equal thickness, as may be seen in FIGS. 2 and 3. The first and second layers 22, 24 are preferably formed of an elastomeric material such as neoprene W or epichlorohydrin.

A third layer 26 is sandwiched between the first and second layers 22, 24 and is formed of a second material different from and less permeable than the first and second layers 22, 24. The third layer 26 is typically formed as a thin film metal layer which is vapor deposited onto the interior surface of one of the first or second layers 22, 24 prior to the elastomeric diaphragm material being cured. Satisfactory results have been obtained by producing the third layer as a vapor deposited film of gold or platinum/palladium which is layered onto one of the elastomeric layers 22, 24 to a thickness of approximately 5 to 25 microns. It has been found that thin layers of gold and platinum/palladium are particularly impermeable to refrigerant fluids which are typically used in refrigeration systems, such as Freon 502, and which permeate relatively easily through elastomeric diaphragm materials. In addition, thin layers of these metals are relatively compliant and thus present little resistance to the movement of the diaphragm 16 as it flexes in response to reciprocation of the piston 14 within the cylinder 12.

Although the thin impermeable layer 26 may be formed as a continuous uniform layer, the preferred structure of the diaphragm 16 is formed with the impermeable layer 26 formed in a grid pattern. As may be seen in FIG. 2, the grid pattern may be defined by a series of circular patches 28 which are substantially uniformly distributed across the operable surface area 11 of the diaphragm 16. In the preferred embodiment, the material forming the grid pattern extends across at least 50% of the operable surface area, and it has been found that by covering 50% to 75% of the operable surface area 11 of the diaphragm 16 with the third layer 26, the permeability of the diaphragm 16 is reduced by a factor 2 to 4 times. Such a grid pattern may be formed by any conventional means such as by a screen having a pattern imprinted on it whereby the third layer 26 is deposited around the areas defined by the pattern on the screen.

By forming the third layer 26 as a grid pattern such as that defined by patches 28, the opposing layers 22, 24 of elastomeric material are exposed to each other in facing relationship at a plurality of points throughout the operable surface area of the diaphragm 16. Thus, when the elastomeric layers 22, 24 are cured during final production of the diaphragm 16, multiple elastomer bonds will be formed throughout the operable surface area 11 at points between the grid pattern such that separation of the layers 22, 24 of the diaphragm 16 is inhibited. In addition, by providing numerous small patches 28 in the grid pattern, it is possible to ensure that a large number of elastomer-to-elastomer bonds are formed such that the elastomer layers 22, 24 are held in close contact with the third layer 26 throughout the area of the operable surface area 11 to thereby ensure that the third layer 26 effectively acts to inhibit permeation of refrigerant from one side of the diaphragm 16 to the other.

Further, the grid pattern 26 is preferably formed only across the operable surface area 11 such that the outer mounting rim portion 15 of the diaphragm 16 is formed entirely by the two elastomeric layers 22, 24. The junction between the operable surface area 11 and the rim portion 15, as defined by the line 13, forms a flexible hinge point having relatively low resistance to bending as the diaphragm 16 moves up and down with the piston 14.

It should be apparent that it is within the scope of the present invention to incorporate other gas impermeable materials for use as the interior layer 26 of the diaphragm 16. For example, a semi-elastic polymer film may be incorporated such as polyvinylidene chloride or polyvinylidene chloride/polyvinyl chloride copolymers. As with the above-described diaphragm incorporating a metal impermeable layer, a diaphragm 16 formed with a impermeable layer formed of a polymer film may be produced by positioning the polymer film between the first and second layers 22, 24 before they are cured such that the polymer film is permanently sandwiched between the two layers 22, 24 upon curing of the diaphragm 16. The thickness of the polymer layer in the preferred embodiment is on the order of 0.001 to 0.006 inches, and the polymer layer is retained within the diaphragm 16 in the same manner as the above-described metal layer such that the polymer film is sandwiched and retained between the two outer layers 22, 24.

In a typical diaphragm 16 constructed according to the teachings of the present invention, the diaphragm 16 is formed as a disk having a diameter of approximately 3 inches. The operable surface area, as defined by the boundary line 13, is typically approximately 2 inches to correspond to the diameter of the compressor cylinder 12, and a plurality of patches 28 formed of impermeable material are distributed uniformly to cover at least 50% of the operable surface area. The final diaphragm has a thickness of approximately 0.070 inches and therefore forms a relatively thin and highly flexible barrier structure between the piston and the refrigerant capable of operating at pressures as high as 350 psia.

It should be apparent that the present invention provides the advantages of a flexible elastomeric diaphragm in combination with the advantages obtained with a gas barrier formed of a highly impermeable material. In addition, by forming the present diaphragm as a sandwich structure in which the impermeable material is encased within the elastomeric material and in which a plurality of polymer to polymer bonds may be formed throughout the operable surface area, the present diaphragm acts to avoid erosion of the impermeable layer which would occur if the impermeable layer were not encased within the elastomeric material. The present construction also provides the advantage that the two elastomeric layers are bonded to each other to encase the impermeable layer and thereby prevent separation of the layers of the diaphragm.

Also, by providing the impermeable layer only in the operable surface area of the diaphragm, the hinge location at the boundary between the operable surface area and the mounting rim of the diaphragm is formed only of elastomeric material such that this area which undergoes the greatest amount of flexure is provided as a highly flexible hinge structure.

While the forms of apparatus herein described constitute preferred embodiments of the invention, it is to be understood that the invention is not limited to these precise forms of apparatus and that changes may be made therein without departing from the scope of the invention which is defined in the appended claims.

What is claimed is:

1. A compliant molded diaphragm having an operable surface area for forming a flexible barrier to prevent fluid flow between opposing sides of said diaphragm, said diaphragm comprising:

first and second layers formed of a first elastomer material; and a third gas impermeable layer located between said first and second layers, said third layer being substantially thinner than said first and second layers and being formed of a second material different from said first material and extending substantially coextensively with said operable surface area to inhibit passage of fluids through said diaphragm.

2. The diaphragm of claim 1 wherein said first and second layers are substantially the same thickness.

3. The diaphragm of claim 1 wherein said first material is formed of a polymer, said second material is formed of a thin layer of metal defining a grid pattern across said operable surface area and said first and second layers are bonded to each other to form polymer to polymer bonds at points between said grid pattern defined by said thin layer of metal.

4. The diaphragm of claim 3 wherein said grid pattern is defined by discrete patches of said metal layer.

5. The diaphragm of claim 3 wherein said grid pattern extends across at least approximately 50% of said operable area.

6. The diaphragm of claim 5 wherein said grid pattern extends across approximately 50% to 75% of said operable area.

7. The diaphragm of claim 1 wherein said third layer is formed of a film of semi-elastic polymer.

8. The diaphragm of claim 7 wherein said semi-elastic polymer is polyvinylidene chloride.

9. The diaphragm of claim 7 wherein said semi-elastic polymer is a polyvinylidene chloride/polyvinyl chloride copolymer.

10. The diaphragm of claim 1 wherein said third layer is formed of a thin layer of metal.

11. The diaphragm of claim 10 wherein said metal is gold or platinum/palladium having a thickness of between approximately 5 and 25 microns.

12. The diaphragm of claim 1 further including a peripheral portion located outside of said operable surface area where said first and second layers are continuously bonded in contact with each other to form a flexible edge for attaching said diaphragm to a mounting structure.

13. A compliant molded diaphragm having an operable surface area for forming a flexible barrier to prevent fluid flow between opposing sides of said diaphragm, said diaphragm comprising:

first and second layers formed of an elastomer material;

a third gas impermeable layer extending substantially coextensively with said operable surface area; and means defining a peripheral portion of said diaphragm where said first and second layers are bonded to each other to thereby effect retention of said third layer in said operable surface area.

14. The diaphragm of claim 13 wherein polymer to polymer bonds are formed in said operable surface area.

15. The diaphragm of claim 13 wherein said third layer is formed of a semi-elastic polymer and said first and second layers are attached to said third layer by application of heat and pressure during a curing process for said first and second layers.

16. The diaphragm of claim 13 wherein said third layer defines a grid pattern across said operable surface area and said first and second layers are bonded to each other to form polymer to polymer bonds at points between said grid pattern defined by said third layer.

17. The diaphragm of claim 16 wherein said grid pattern is defined by a pattern of circles substantially uniformly distributed across said operable surface area.

* * * * *